United States Patent [19]

Jansz

[11] 3,998,064

[45] Dec. 21, 1976

[54] SUBAQUEOUS PILE DRIVING APPARATUS AND METHOD

[75] Inventor: Joost W. Jansz, The Hague, Netherlands

[73] Assignee: Hollandsche Beton Groep N.V., Rijswijk, Netherlands

[22] Filed: June 19, 1975

[21] Appl. No.: 588,554

[30] Foreign Application Priority Data

June 27, 1974 Netherlands ..... 7408710
Aug. 14, 1974 Netherlands ..... 7410905

[52] U.S. Cl. ..... 61/53.5; 61/69 R; 173/1; 173/112

[51] Int. Cl.[2] ..... E02D 7/00

[58] Field of Search ..... 61/53.5, 69; 173/DIG. 1, 112; 175/6

[56] References Cited

UNITED STATES PATENTS

| | | | |
|---|---|---|---|
| 26,073 | 11/1859 | Whipple | 173/DIG. 1 |
| 3,345,879 | 10/1967 | Nasu et al. | 175/6 X |
| 3,846,991 | 11/1974 | Wisotsky | 61/53.5 |

FOREIGN PATENTS OR APPLICATIONS

| | | | |
|---|---|---|---|
| 184,315 | 4/1907 | Germany | 61/53.5 |

*Primary Examiner*—Jacob Shapiro
*Attorney, Agent, or Firm*—Sughrue, Rothwell, Mion, Zinn & Macpeak

[57] ABSTRACT

There is disclosed a system for subaqueous pile driving in which the pile and the hammer are completely submerged. The pile is suspended by at least one cable in such a manner that two cable sections are run in an upward direction from the top of the pile in a parallel manner toward a device located above sea level. The pile is lowered on the cables to the ocean floor, and the pile driving hammer positioned on top of it simultaneously with the pile hammer guided on cable sections. A traverse bore is provided in the pile for passage of the cable, and a temporary support base is provided having slidable frictional contact with the pile for enlarging the base of the pile on the ocean floor.

7 Claims, 5 Drawing Figures

SUBAQUEOUS PILE DRIVING APPARATUS AND METHOD

BACKGROUND OF THE INVENTION

This invention relates to a method of subaqueous pile driving, in which the pile and pile hammer are brought under water. Such a method is known. With said known method, firstly a guide pile is positioned on the ground which projects above the water-level and the pile to be driven as well as the pile hammer are guided along said pile. Such a method is complicated and is more difficult and more expensive as the depth of water increases.

It is an object of the invention to provide a method and appertaining device with which pile driving under water is made possible in a simple manner.

In accordance with the invention, said object is achieved in that the pile at the top is suspended on one or more cables in such a manner that in any case at least two cable sections run upwards from the top of the pile, parallel to each other, towards a device above water-level, by means of which the pile can be lowered by the cables onto the ocean floor and for the process of lowering the pile hammer is positioned on the top or head of the pile and is lowered along with the pile, in which the pile hammer is guided on the cable sections. In accordance with the invention use is no longer made of a guide pile but the pile and pile hammer are suspended on one or more cables and the whole assembly is lowered with the lower end of the pile facing the region where the pile will be driven into the ground. If required, the pile point may be steered by means of easily detachable cables secured near the point, e.g. when due to currents there is some difficulty in directing the pile point. During lowering, the cables take care that the sometimes top-heavy assembly of pile and pile hammer does not tilt.

If for some reasons the process of pile driving has to be interrupted and the ram has to be raised, it may be guided back along the cables to the pile head.

If the pile point has reached the ocean floor and the point has penetrated into the ground preferably by virtue of its own weight and the weight of the ram, pile driving may begin. Use is made of the flexibility of the, if required, already lowered cable or cables, which, of course, are lowered further after each blow, in which certainly at the beginning the value of the tension in the cables is kept such that the pile and pile hammer can be kept upright. Such tension may be less than the tension resulting from the proper weight of pile and pile hammer.

At the beginning, one has to be careful when driving the pile but this is no problem inasmuch as it can be controlled with a pile hammer of the type known from Dutch Pat. No. 137,548.

The lower end of the pile is preferably provided with a temporary support, said support enlarging the base and having a slidable frictional contact with the pile. The stability of the pile is thus increased. Said support has a connection with the pile of a kind that during pile driving the pile will slide through said support until the pile driving device has reached the support device. Said support device should then be removed but it may also be a structure which can be demolished by the pile driving apparatus.

The invention also relates to a device for applying the method and said device comprises a bearing element to which the pile head may be secured and to which the cable or cables may be connected, a pile hammer, said hammer being provided with means for guiding the cable sections therethrough, as well as lifting means above the water-level for carrying, lowering and hoisting the cable and the pile hammer. Said bearing element may consist of a clamping device on the top or head of the pile and fastenings for cables running towards a lifting device. The pile hammer is suspended in a known manner on another lifting device.

If the ground is very soft, the afore-mentioned support device cannot be used. Due to the fact that the pile does not encounter much resistance in the soft ground, the cable or cables acting as bearers of the pile will have to take considerable blows, which is undesirable.

It is the object of the invention to provide also a solution for this problem and this is achieved in that the means of the pile hammer for guiding the cable or cables of the pile are constituted by a long framework, wherein the pile hammer and the pile are guided freely slidable in a vertical direction, said framework being secured to the lifting means for the pile hammer. If the frame is suspended on its hoisting cable and one creates a slack in the carrying cables of the pile and, thus, takes away partly or completely the stabilizing effect of said carrying cables on the position of the pile, said guide frame partly or fully takes over the stabilizing function, as a result of which, depending on the circumstances, the loads which would occur otherwise in the carrying cables can be considerably reduced and/or fully neutralized.

In accordance with the invention the bearing element may also be provided with cable discs for guiding a through cable, one end of said cable being secured to a stationary point of the lifting means and the other end being secured to the movable portion of the lifting means. The principle of the pulley-block is thus, advantageously applied. If the principle of the pulley-block is applied with a singular, the cable discs should be disposed on either side of the pile in a vertical mid-section of same and the pile is provided with a transverse bore through which the cable is guided. If the principle of lifting is carried out in duplicate by passing the cable over a cable disc on the lifting device and by having the cable run back over a second pair of discs near the pile head, then four discs are needed which may be located at such distances from each other and in such a manner relatively to the pile that no transverse bores are needed, but the cable sections are guided along the sides of the pile. This is also the case when the principle of single lifting is applied with two parallel cables.

BRIEF DESCRIPTION OF THE DRAWINGS

The invention will now be explained more in detail with reference to the diagrams, wherein.

DESCRIPTION OF THE PREFERRED EMBODIMENT

Figure 1:
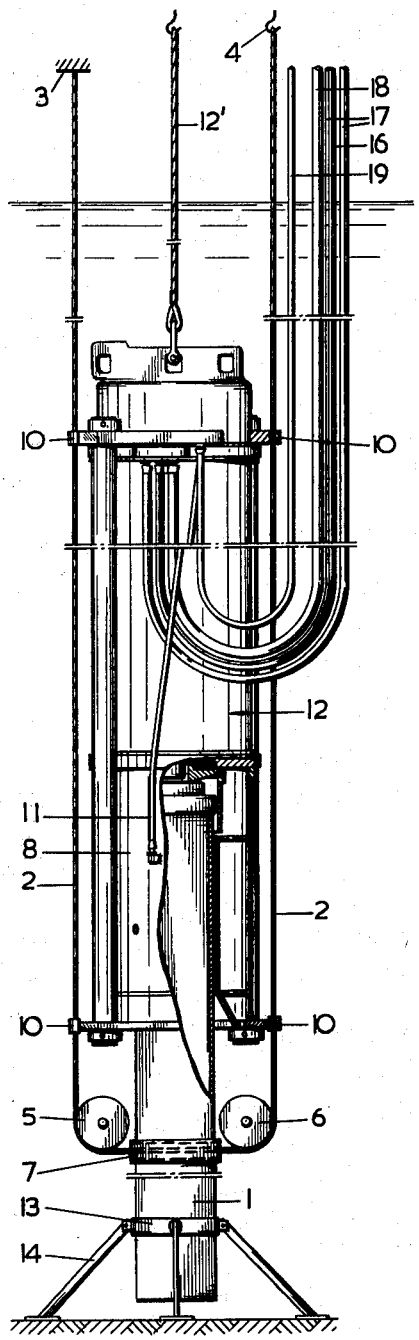
FIG. 1 illustrates the pile driving device in accordance with the invention.

FIG. 1 shows a pile 1 being suspended on a cable 2, one end of which being secured at reference numeral 3 to a fixed point of a device not illustrated further, such as a platform or a vessel, being disposed above water-level and being provided with lifting means, and the other end of said cable 2 being secured to the lifting device at reference numeral 4.

Said cable 2 passes over discs 5 and 6 of a bearing element not illustrated further, but which may consist of a clamp collar with brackets wherein the discs are bear-mounted, said cable passing through a tube 7 traversing the pile. Said tube is welded onto the walls of the steel pile, and serves as a means for facilitating the passing-through of the cable. If a concrete pile is used, it is sufficient to have a transverse bore which may be reinforced, if desired, with a tube.

Above the bearing element with discs 5 and 6, hammer 12 is disposed on the head of the pile, said hammer being provided with a casing 8 embracing the pile head over a certain height and compressed air may be supplied to said casing via the hose line 11 for removing the water from the area around the pile head so that the striking takes place in air. Said casing is put under pressure as soon as the hammer enters the water. The hammer is provided with guide eyes 10 with which near the lower end of the casing 8 and near the upper end, the hammer is guided on cable 2 and, thus, also supported in transverse direction by the cable. It is true that the hammer is suspended on a separate lifting device by means of cable 12′ but the purpose of said device is only to bring the hammer to the pile and to withdraw same later-on.

The casing 8 may be provided with a downwardly widening opening with which the hammer is positioned onto the pile in a simplified manner, especially when the inner portion of the casing connects to the pile in such a manner that pile and hammer are kept in line.

When the pile point has been lowered onto the ground the tension in cable 2 will be decreased and this can easily be observed by the operator of the crane. He may then start carefully with striking, while still keeping the cable 2 slightly under tension. After a few strokes the tension in cable 2 may almost be eliminated.

In order to simplify the process of pile driving at the beginning, the lower end of the pile may have been provided with a temporary support device, said device comprising a sleeve member 13 and support legs 14. Said sleeve member has a frictional contact with the pile and the legs 14 are preferably constructed in a manner that they can keep the pile in upright position and they are demolished as soon as they come under direct influence of the impact effect of the ram. It is, however, also conceivable to use a support device consisting of parts which may be separated from each other and recovered individually. Said support device might be embodied in such a manner that the clamping sleeve 13 consists of two sections which are interconnected by means of explosive bolts. This can be done also with the bearing element, which may also be recovered.

The drawing illustrates a number of hoses 15, 16, 17 and 18 which serve for the supply of high pressure oil, control of the force of the blow, the air supply to the hammer and the return of low pressure oil respectively. The pressure in the casing section 8 of the hammer is controlled via the pipe 19.

Figure 2:
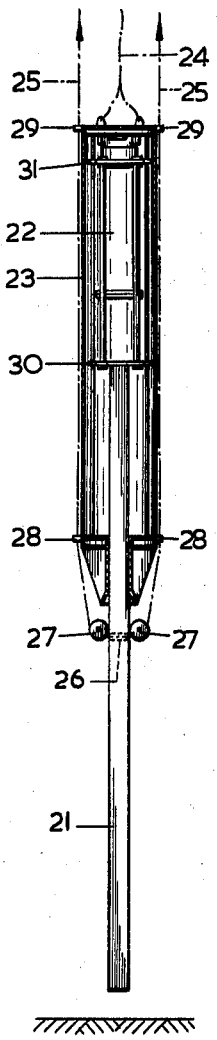
FIGS. 2 up to 5 inclusive illustrate a different embodiment of the device in accordance with the invention in different positions.

The device illustrated in FIGS. 2 up to 5 inclusive is intended for pile driving in soft ground in which the support device 13, 14 cannot be used.

FIG. 2 illustrates pile 21 and hammer 22 disposed thereon.

Pile 21 and hammer 22 are guided in a frame 23 being suspended on hoisting cable 24. Pile 21 is suspended on cable 25 running through transverse channel 26 of the pile, over discs 27 and guide means 28, 29 of frame 23. Cable 25 runs upwards towards lifting means (not illustrated).

FIG. 2 illustrates the position during the lowering of the pile. The pile is suspended on cable 25 and carries the hammer and frame 23 resting thereon.

When the device in this position reaches the ground, the process of lowering is continued until one notices by the tension in cable 25 that the pile encounters resistance. Cable 24 is then tensioned until it carries frame 3, whereupon the tension in cable 25 depending on the resistance to be expected is eliminated completely or partly. The hammer will then operate and move downwards with the pile at each strike and will be guided by the guide means 30 and 32 in frame 23.

Figure 3:
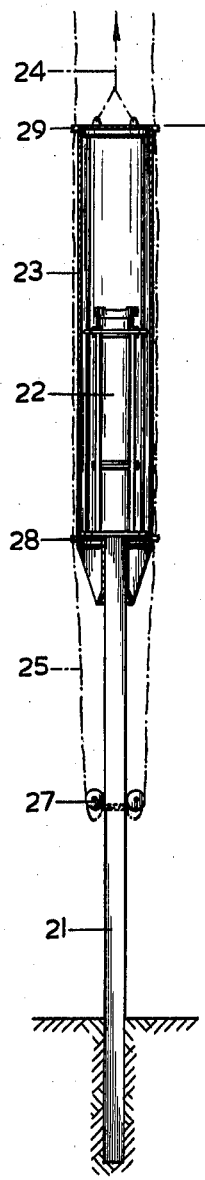
Figure 4:
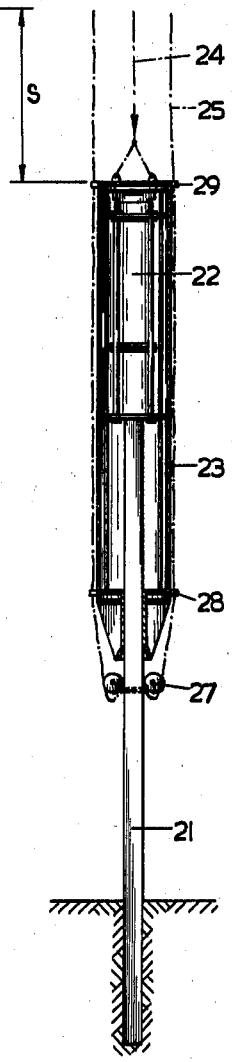

When in this manner the position illustrated in FIG. 3 has been reached, the tension in cable 25 is increased again so that in any case frame 23 may be lowered and in doing so, said frame is guided on the hammer and on cable 25 until the position has been reached which is illustrated in FIG. 4. The tension in cable 25 is then decreased again and eliminated respectively and the hammer may travel again the distance indicated by reference numeral S.

Figure 5:
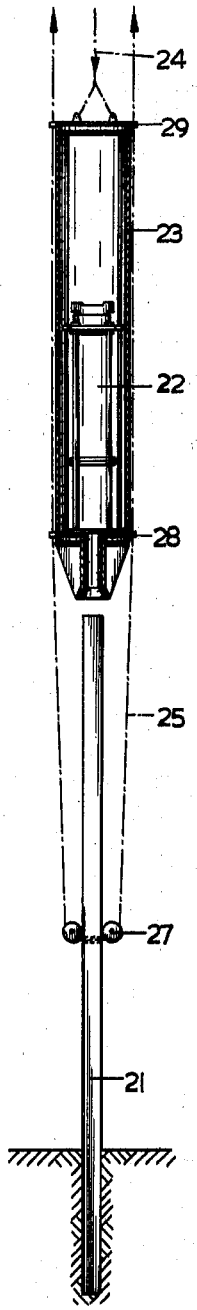

FIG. 5 illustrates the possibility with the present embodiment to lift the hammer in the guide frame in case of failure, to carry out the necessary repair and maintenance above water-level and to position frame and hammer again onto the pile head via cables 25.

I claim:

1. In a system of subaqueous pile driving from a device above water level, in which the pile and pile hammer are brought completely under water, the improvement comprising: said pile suspended on at least one cable in such a manner that at least two cable sections run upwards from the top of said pile, parallel to each other, towards said device above the water-level, means carried by said device for lowering the pile on the cables to the ocean floor, said means also lowering the pile hammer and positioning it on the top of the pile, wherein said hammer is lowered simultaneously with said pile, and the pile hammer is guided on the cable sections.

2. The system in accordance with claim 1, wherein the pile at its lower end is provided with a temporary support means, said support means enlarging the base and having a slidable frictional contact with said pile.

3. The system of claim 1 including a bearing element secured to the pile head and the cable, said pile hammer being provided with means for guiding the cable sections therethrough, and lifing means above the water-level for carrying, lowering and lifting the cable and the pile hammer.

4. The system of claim 3, wherein the means for guiding the cable or cables of the pile comprise a framework wherein the pile hammer and the pile are guided freely slidable in a vertical direction, said framework being secured to the lifting means for the pile hammer.

5. The system of claim 3 wherein the bearing element has a plurality of cable discs for guiding a cable, one end of said cable being secured to a stationary point and the other end being secured to the movable portion of the lifting means.

6. The system of claim 5, wherein the pile is provided with a transverse bore or channel for the passage of the cable.

7. The system of claim 2, wherein the support device comprises a sleeve member fitting on the pile, said sleeve member having a frictional contact with the pile wall, and support legs being directed outwards from said sleeve member, said support legs being constructed in such a manner that they may be demolished under the direct influence of the action of the pile hammer.

* * * * *